US009842682B2

(12) United States Patent
Yan et al.

(10) Patent No.: US 9,842,682 B2
(45) Date of Patent: Dec. 12, 2017

(54) MODULAR INTEGRATED MULTI-PHASE, NON-COUPLED WINDING POWER INDUCTOR AND METHODS OF MANUFACTURE

(71) Applicant: COOPER TECHNOLOGIES COMPANY, Houston, TX (US)

(72) Inventors: Yipeng Yan, Shanghai (CN); Jinliang Xu, Shanghai (CN); Dengyan Zhou, Shangahi (CN); John J. Janis, Oxford, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 124 days.

(21) Appl. No.: 15/054,794

(22) Filed: Feb. 26, 2016

(65) Prior Publication Data

US 2017/0178794 A1 Jun. 22, 2017

Related U.S. Application Data

(63) Continuation of application No. PCT/CN2015/098193, filed on Dec. 22, 2015.

(51) Int. Cl.

| | |
|---|---|
| ***H01F 27/24*** | (2006.01) |
| ***H01F 27/02*** | (2006.01) |
| ***H01F 27/28*** | (2006.01) |
| ***H01F 27/26*** | (2006.01) |
| ***H01F 41/02*** | (2006.01) |

(52) U.S. Cl.

CPC ..... *H01F 27/2847* (2013.01); *H01F 27/263* (2013.01); *H01F 41/02* (2013.01)

(58) Field of Classification Search

CPC ..... H01F 38/12; H01F 27/292; H01F 27/245; H01F 27/2847; H01F 23/5227

USPC .... 336/83, 90, 212, 200, 220, 221, 222, 232

See application file for complete search history.

(56) References Cited

U.S. PATENT DOCUMENTS 5,747,981 A * 5/1998 Callanan ..... H01F 38/023 323/362
7,271,695 B2 * 9/2007 Wadlington ..... H01F 30/12 29/602.1
7,598,839 B1 * 10/2009 Wedley ..... H01F 3/12 336/131

(Continued)

FOREIGN PATENT DOCUMENTS

CN 201877237 U 6/2011
CN 203552851 U 4/2014

(Continued)

OTHER PUBLICATIONS

International Search Report and Written Opinion of International Application No. PCT/CN2015/098193, dated Sep. 30, 2016, 13 pages.

*Primary Examiner* — Tsz Chan
(74) *Attorney, Agent, or Firm* — Armstrong Teasdale LLP

(57) ABSTRACT

A surface mount, power inductor component assembly includes only two different shapes of modular core pieces and a set of windings having the same shape that can be assembled and arranged to have any desired number of non-magnetically coupled windings to accommodate electrical power systems having different numbers of phases of electrical power. The core pieces and windings are vertically elongated to reduce the component footprint on a circuit board yet provide higher power, higher current capability.

20 Claims, 7 Drawing Sheets

(56) References Cited

U.S. PATENT DOCUMENTS

| | | | | |
|---|---|---|---|---|
| 8,031,042 | B2 * | 10/2011 | Silva | H01F 3/10 336/178 |
| 2004/0017276 | A1 | 1/2004 | Chen et al. | |
| 2004/0160298 | A1 | 8/2004 | Hsu et al. | |
| 2006/0290458 | A1 * | 12/2006 | Sano | H01F 3/12 336/212 |
| 2012/0056704 | A1 * | 3/2012 | Nagano | H01F 30/06 336/170 |

FOREIGN PATENT DOCUMENTS

| | | | |
|---|---|---|---|
| CN | 104282411 | A | 1/2015 |
| CN | 105097188 | A | 11/2015 |

* cited by examiner

MODULAR INTEGRATED MULTI-PHASE, NON-COUPLED WINDING POWER INDUCTOR AND METHODS OF MANUFACTURE

CROSS REFERENCE TO RELATED APPLICATIONS

This application is a continuation application of International Application No. PCT/CN2015/098193.

BACKGROUND OF THE INVENTION

The field of the invention relates generally to electromagnetic inductor components, and more particularly to an integrated, multi-phase power inductor component having a configurable number of non-magnetically coupled coil windings for circuit board applications.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit by inducing current flow through the windings. Power inductors may, for example, provide regulated power from rapidly switching power supplies in an electronic device. Power inductors may also be utilized in electronic power converter circuitry.

Power inductors are known that include multiple windings integrated in a common core structure. Existing power inductors of this type however, are problematic in some aspects and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
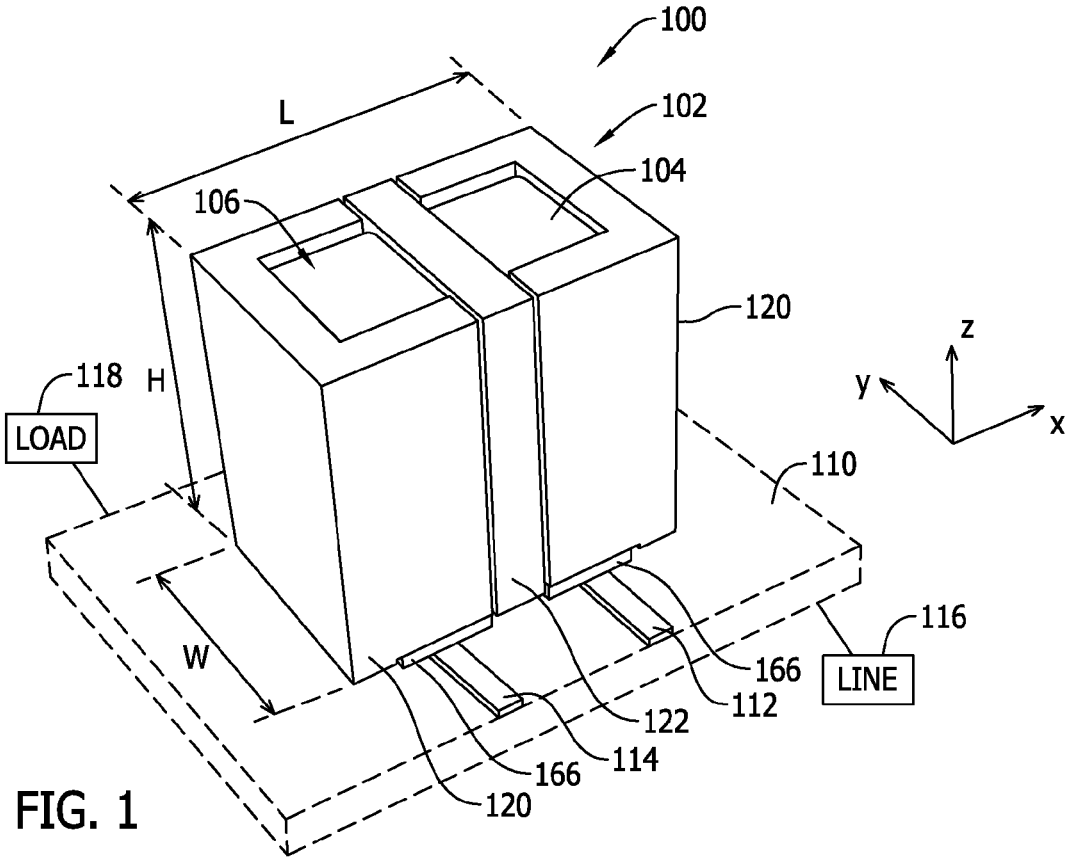
FIG. 1 is a top perspective view of a first exemplary embodiment of an electromagnetic surface mount, power inductor component assembly.

As mentioned above, electromagnetic power inductors are known that include, for example, multiple windings integrated in a common core structure. Such inductor components are typically beneficial to provide multi-phase power regulation at a reduced cost relative to discrete inductor components including separate magnetic cores and windings for each respective phase of electrical power. As one example, a two phase power system can be regulated with an integrated power inductor component including two windings. One winding is connected to the first power phase of electrical circuitry on a circuit board, and the other winding is connected to the second power phase of electrical circuitry on a circuit board. The integrated windings on a common core structure typically saves valuable space on the circuit board relative to providing one discrete inductor component including its own magnetic core for each phase. Such space savings can contribute to a reduction in size of the circuit board and also the electronic device including the circuit board.

Known integrated multi-phase power inductor component constructions are limited, however, in certain aspects and are therefore undesirable for application in certain types of electrical power systems. As such, existing power inductor constructions have yet to fully meet the needs of the marketplace in certain aspects.

For example, in multi-phase power supply applications, inductance unbalance issues between different phases connected to each winding can be problematic, and thus achieving balanced performance can be particularly difficult for smaller components in higher power, higher current applications that modern day electrical devices demand.

Also, multi-phase electrical power systems are in widespread use including different numbers of phases of electrical power. As a result, customized components tend to be the norm to meet the needs of power systems having different numbers of phases. The customized nature of such components tends to increase the cost of manufacture and assembly for the components. In particular, the core constructions tend be different for inductor components having one, two, three or more windings. It would be desirable to provide a set of power inductors that can be manufactured from a reduced number of parts, and in particular from modular magnetic core pieces that can be assembled to easily configure inductors having different numbers of windings at relatively low cost.

Saturation current (Isat) performance tends to be limited by the core construction in known integrated multi-phase power inductor components. Improvement is desired for state of the art electrical power systems for higher powered electronic devices.

The form factor of known integrated multi-phase power inductor components, including the "footprint" (understood by those in the art as a reference to an area that the component occupies on a plane of the circuit board) and profile (understood by those in the art as a reference to the overall component height measured perpendicular to the plane of the circuit board) can effectively limit the ability of the component to perform in higher current, higher power system applications. Balancing the power demands of higher power circuitry with a desire for ever-smaller components is a challenge.

Finally, alternating current resistance (ACR) caused by fringing effect of integrated multi-phase power inductor component in use can be undesirably high in known component constructions.

Exemplary embodiments of integrated electromagnetic multi-phase inductor component assemblies for power supply circuitry on a circuit board (i.e., power inductors) are described hereinbelow that overcome at least the disadvantages described above. The exemplary inductor component assemblies achieve this at least in part via modular core pieces that can be selectively assembled with a set of conductive windings in any number desired while simplifying assembly of the component and lowering manufacturing cost. Fringing flux from conventionally employed discrete air gaps in the core structure are avoided and ACR caused by fringing effect is accordingly reduced while providing reliably balanced operation of the windings in use for each power phase. Higher power capability is provided with three dimensional conductive windings formed from planar conductive material and core structure that has a relatively small footprint in combination with a relatively taller profile to accommodate higher power, higher current applications.

Figure 2:
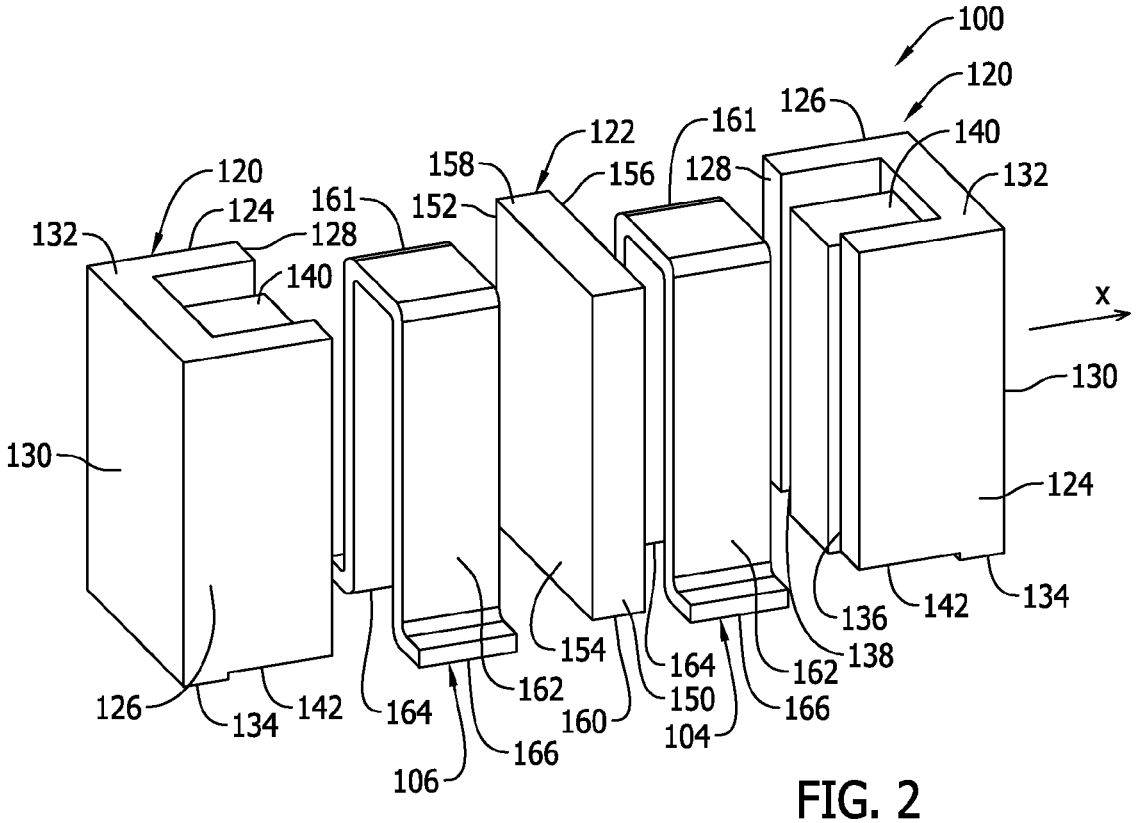
FIG. 2 is an exploded view of the power inductor component assembly shown in FIG. 1.
Figure 3:
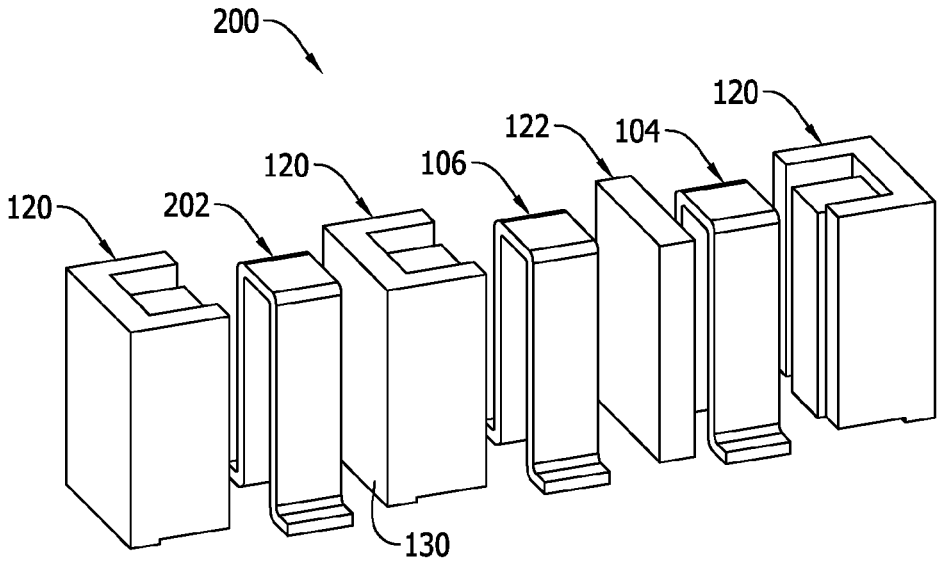
FIG. 3 is an exploded view of a scalable power inductor component assembly including the inductor component assembly shown in FIG. 1.
Figure 4:
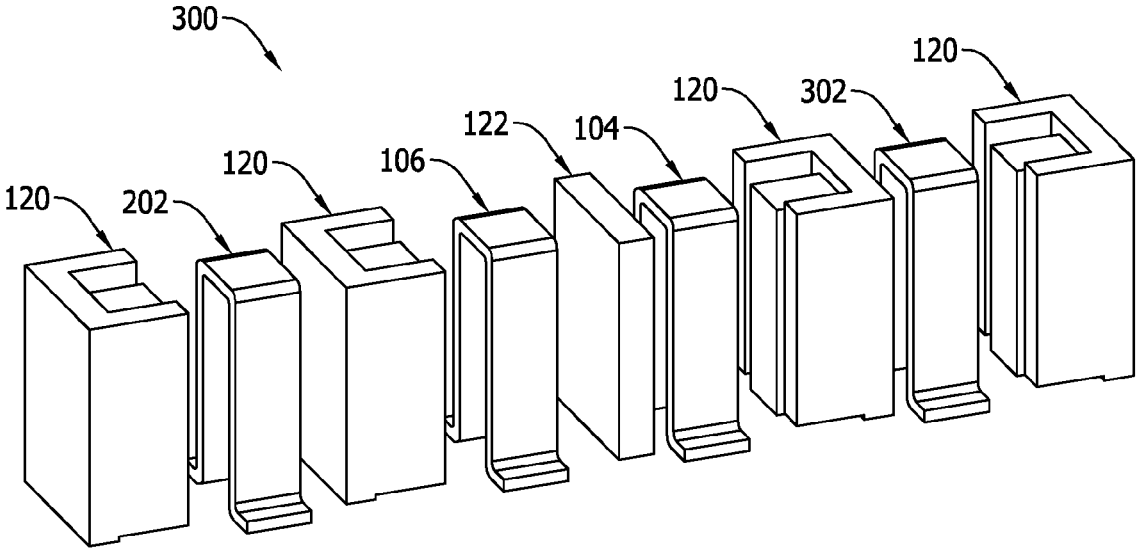
FIG. 4 is an exploded view of a scalable power inductor component assembly including the inductor component assembly shown in FIG. 3.

FIG. 1-4 illustrate various views of a first exemplary embodiment of a surface mount, power inductor component assembly 100. FIG. 1 shows the power inductor component assembly 100 in perspective view. FIGS. 2 through 4 are exploded view of the power inductor component assembly 100 and assemblies including the component assembly 100 that are configured to include different numbers of windings for electrical power systems having different numbers of phases.

The power inductor component assembly 100 generally includes, as shown in FIG. 1, a magnetic core 102 with integrated conductive windings 104 and 106 respectively arranged in the magnetic core 102, and a circuit board 110.

The circuit board 110 is configured with multi-phase power supply circuitry, sometimes referred to as line side circuitry 116, including conductive traces 112, 114 provided on the plane of the circuit board in a known manner. In the example shown in FIG. 1, the line side circuitry 116 provides two phase electrical power, and in contemplated embodiments the first conductive trace 112 corresponds to a first phase of the multi-phase power supply circuitry and the second conductive trace 114 corresponds to the second phase of the multi-phase power supply circuitry. In turn, the first conductive winding 104 is connected to the first conductive trace 112 and the first phase and the second conductive winding 106 is connected to the second conductive trace 114 and the second phase of the multi-phase power supply circuitry. While a two phase power system is represented and the inductor component is configured as a dual inductor having two windings 104 and 106, greater or fewer numbers of phases in the multi-phase power supply circuitry may alternatively be provided as illustrated in the following Figures, and a corresponding number of windings to the phases provided may be included in the magnetic core 102. That is, and as explained below, the component may alternatively be configured for three, four or more windings for power systems including three or more phases.

It is understood that more than one inductor component including the core piece 102 and windings 104 and 106 may be provided on the board 110 as desired. Other types of circuit components may likewise be connected to the circuit board 110 to complete, for example, a power regulator circuit and/or a power converter circuit on the board 110. As such power regulator and converter circuits are generally known and within the purview of those in the art, no further description of the circuitry is believed to be necessary. While not seen in FIG. 1, circuit traces are also included on the circuit board 110 on the other side of the power inductor component illustrated to establish electrical connection to load side circuitry 118 downstream from the conductive windings 104, 106 in the circuitry.

The magnetic core 102 in the example shown has includes a number of generally orthogonal sides imparting an overall rectangular or box-like shape and appearance. The size and shape of the core 102 shown in FIG. 1 is the result of an assembled combination of modular magnetic core pieces described further below. The box-like shape of the magnetic core 102 in the illustrated example has an overall length L measured along a first dimensional axis such as an x axis of a Cartesian coordinate system, a width W measured along a second dimensional axis perpendicular to the first dimension axis such as a y axis of a Cartesian coordinate system, and a height H measured along a third dimensional axis extending perpendicular to the first and second dimensional axis such as a z axis of a Cartesian coordinate system.

The dimensional proportions of the magnetic core 102 runs counter to recent efforts in the art to reduce the height dimension H to produce as low profile components as possible. In higher power, higher current circuitry, as the height dimension H is reduced per recent trends in the art, the dimension W (and perhaps L as well) tends to increase to accommodate coil windings capable of performing in higher current circuitry. As a result, and following this trend, a reduction in the height dimension H tends to increase the width W or length L and therefore increase the footprint of the component on the board 110. The assembly 100 of the present invention, however, favors an increased height dimension H (and increased component profile) in favor of a smaller footprint on the board 110. As seen in the example of FIG. 1, the dimensions L and H are both much greater than the dimension W. Component density of the circuit board 110 may accordingly be increased by virtue of the smaller footprint of the component on the circuit board 110.

As seen in FIG. 1, a portion of each of the coil windings 104 and 106 are each exposed on a side of the magnetic core 102 in a slightly recessed manner. The exposed coil windings 104 and 106 are relatively large in the x, y plane to capably handle higher current, higher power applications beyond the limits of conventional electromagnetic component constructions of an otherwise similar size.

In contemplated embodiments, the magnetic core 102 may be assembled from a selected number of modular magnetic core pieces such as those described below. The modular core pieces may be fabricated utilizing soft magnetic particle materials and known techniques such as molding of granular magnetic particles to produce the desired shapes. Soft magnetic powder particles used to fabricate the core pieces may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. In some cases, magnetic powder particles may be are coated with an insulating material such the core pieces may possess so-called distributed gap properties familiar to those in the art and fabricated in a known manner. The core pieces may be fabricated from the same or different magnetic materials and as such may have the same or different magnetic properties as desired. The magnetic powder particles used to fabricate the core pieces may be obtained using known methods and techniques and molded into the desired shapes also using known techniques.

Turning now to the exploded view of FIG. 2, the magnetic core 102 is seen to include two different shapes of modular magnetic core pieces arranged with the windings 104 and 106, namely a pair of first magnetic core pieces 120 on either end of the assembly and a second magnetic core piece 122 in the middle. The core pieces 120 are identically shaped but inverted relative to one another in a mirror-image arrangement on either side of the core piece 122, with the windings 104, 106 received between the core pieces 120 and 122.

In the example shown, each magnetic core piece 120 is formed with opposing first and second longitudinal side walls 124 and 126, opposing first and second lateral side walls 128 and 130 interconnecting the first and second longitudinal side walls 124 and 126, and opposing top and bottom walls 132 and 134 interconnecting the respective first and second longitudinal side walls 124 and 126 and the respective first and second lateral side walls 128 and 130. In the context of FIGS. 1 and 2, the "bottom" wall 134 in each piece 120 is located adjacent the circuit board 110 and the "top" wall is located at some distance from the circuit board 110. Each piece 120 has a generally rectangular configuration including a generally planar top surface and a generally planar opposing bottom surface opposing the top surface and extending in the x, y plane of FIG. 1 and parallel to the major surface of the circuit board 110.

In the example pieces 120 shown, the surface of the lateral side wall 130 of each core piece is generally flat and planar, while the surface of the opposing longitudinal side wall 128 is shaped and contoured to receive the respective winding 104, 106 as described below. Moreover, and in the example shown, each of the bottom wall 134 and the top wall 132 is shaped and contoured to receive a portion of the windings 104, 106.

More specifically, the lateral side wall 128 includes spaced-apart vertical slots 136, 138 extending in a direction generally parallel to the longitudinal side walls 124, 126 and perpendicular to the top wall 132 and the bottom wall 134. The slots 136, 138 extend in a direction perpendicular to the surface of the lateral side wall 130 for a distance sufficient to receive the corresponding vertical portions of the respective windings 104, 106.

The top wall 132 defines a recessed surface 140 extending to the ends of the slots 136, 138 in the lateral side wall 128. The recessed surface 140 is inset and depressed from the surface of the top wall 132 such that where the recessed surface 140 resides the lateral side wall has a height dimension that is less than the height H of the remainder of the top surface 132. The inset recessed surface 140 extends adjacent to and is accessible from the lateral side wall 128, but is spaced from each of the lateral side walls 124, 126. The surface 140 is recessed from, but extends generally parallel to the top wall 130 to accommodate a portion of the coil winding 104, 106 as explained below.

As shown in FIG. 2, the bottom wall 134 in each piece 120 includes a recessed surface 142 that extends to the lateral side 128 and to the slots 136, 138 therein.

The core piece 122 is seen in the Figures to be differently shaped from the core pieces 120 and essentially defines a solid dividing wall or separation wall between the windings 104, 106 and the core pieces 120. The core piece 122 is formed with opposing first and second longitudinal side walls 150 and 152, opposing first and second lateral side walls 154 and 156 interconnecting the first and second longitudinal side walls 150 and 152, and opposing top and bottom walls 158 and 160 interconnecting the respective first and second longitudinal side walls 150 and 152 and the respective first and second lateral side walls 154 and 156. In the context of FIGS. 1 and 2, the "bottom" wall 160 in the piece 122 is located adjacent the circuit board 110 and the "top" wall is located at some distance from the circuit board 110. Unlike the core piece 120, the lateral walls 150 and 152, the longitudinal walls 154 and 156, and the top and bottom walls 158, 160 of the core piece 122 are flat and planar, and are not shaped to receive any portion of the windings 104, 106.

The windings 104, 106 are separated from one another on opposing sides of the core piece 122 by an amount sufficient to avoid magnetic coupling of the windings 104, 106 inside the completed core 102. In a multi-phase power inductor application contemplated, magnetic coupling of the windings 104, 106 is undesirable as it may contribute to imbalanced inductance between the respective phases of power.

Each of the conductive windings 104 and 106 are formed as identically shaped and fabricated elements. Each winding 104, 106 is fabricated from a thin strip of conductive material that is bent or otherwise shaped or formed into the geometry shown. In the illustrated example, each winding 104, 106 includes a planar winding section 161 exposed on the top side 132 of each core piece 120 and first and second planar legs 162, 164 each extending perpendicular to the planar winding section 161 and opposing one another. As such, and in the illustrated example, the windings 104 and 106 are generally inverted U-shaped members with the section 161 being the base of the U and the legs 162, 164 extending downward from the section 161.

In the illustrated embodiment, the legs 162, 164 are disproportionately longer that the section 161 along an axis of the winding. That is, the legs 162, 164 have a first axial length that is much larger than the axial length of the winding section 161. For example, the axial length of the legs 162, 164 may be about three times the axial length of the section 161, although this is not strictly necessary in all embodiments. The proportions of the windings 104, 106 facilitate a reduced footprint of the completed inductor component on the circuit board 110 as explained above, and the increased height of the windings 104, 106 provides a winding of sufficient length to capably handle higher current in a higher power electric system on the circuit board 110.

In the example shown, ends of the legs 162, 164 in each winding 104, 106 are further formed to include surface mount termination pads 166. The surface mount termination pads 166 extend perpendicularly to the plane of the legs 162, 164, extend generally coplanar to one another, and extend parallel to but in a plane offset from the winding section 161. In each winding, the surface mount termination pads 166 extend in opposite directions from one another. The surface mount termination pads 166 provide a larger area for surface mounting to the circuit board 110, but in some cases may be considered optional and need not be provided.

The U-shaped windings 104, 106 are rather simply shaped and may be fabricated at low cost from a conductive sheet of material having a desired thickness into the three-dimensional shape as shown. The windings 104, 106 may be fabricated in advance as separate elements for assembly with the core pieces 120 and 122. That is, the windings 104, 106 may be pre-formed in the shape as shown for later assembly with the core pieces 120 and 122. The U-shaped windings 104, 106 define less than one complete turn in the magnetic core and are less complicated and more easily assembled than larger and more complex multi-turn coils.

To assemble the component, the winding 104 is assembled to the first core piece 120 and the winding 106 is assembled to the second core piece 120 by inserting the legs 162, 164 of each winding into the respective slots 136, 138 in the lateral side wall 128. The winding section 161 is received over the recessed surface 140 in the top wall 132, and the surface mount termination pads 166 are received in the recessed surfaces 142 on the bottom wall 134 in each core piece. Each core piece 120 receives the entire winding 104, 106 in the x dimension (FIG. 1). The core pieces 102 including the windings 104, 106 are then arranged side-by-side with the core piece 122. The lateral side walls 128 of each core piece 120 are bonded to the respective lateral side walls 154, 156 of the core piece 122. The windings 104, 106 are then captured in place. When assembled, the surface mount termination pads 166 extend to, but not beyond the side walls 124, 126 of the core pieces 120 on the bottom side wall 134. The footprint of the component on the circuit board 110, as well as the profile of the component in the height dimension H, is therefore unaffected by the presence of the termination pads 166.

Optionally, the core pieces 120 or 122 can be shaped to produce a physical gap in the assembled core 102 that may enhance energy storage in the component 100 in certain applications. For example, the area of the lateral side wall 128 in each core piece 120 between the slots 136, 138 may be formed with reduced dimension along the x axis relative to the remainder of the side wall 128. Variations are possible to form different gaps of different sizes in various desired locations in the construction of the core 102.

The exemplary inductor component assembly 100 is beneficial in at least the following aspects. The separately fabricated core pieces permit sliding assembly of the windings 104, 106 and relatively precise positioning thereof with relatively low cost. Assembly of the component is therefore simplified and manufacturing cost is lowered. The component assembly 100 is operable with balanced inductance between the different phases of electrical power connected to each winding while still reliably operating in higher power, higher current applications that modern day electrical devices demand. The assembly reduces, if not minimizes, fringing flux from conventionally employed discrete air gaps in the core structure, and ACR caused by fringing effect is accordingly reduced in operation of the assembly 100. Higher power capability is provided with three dimensional conductive windings 104, 106 formed from planar conductive material and relatively simple core structure that has a relatively small footprint in combination with a relatively taller profile to accommodate higher power, higher current applications. Saturation current ($I_{sat}$) performance is enhanced. The component assembly 100 may be manufactured at relatively low cost, yet offer performance that many conventional power inductors are incapable of delivering.

FIGS. 3 and 4 illustrate additional exploded views of inductor component assemblies 200, 300 including the assembly 100 and illustrating the use of the modular core pieces 120 and 122 being arranged to easily configure the assembly to include additional windings.

In FIG. 3, a third core piece 120 is provided with a third winding 202 that is similar to the windings 104, 106. The winding 202 is fitted with the third core piece 202 and is bonded to the lateral wall 130 of the core piece 120 on an end of the assembly 100 described above. The assembly 200 as shown is suited for a three-phase electrical power system with similar benefits to those described above.

In FIG. 4, the assembly 300 is further expanded to include a fourth core piece 120 and a fourth winding 302 that is similar to the windings 104, 106. The winding 302 is fitted with the fourth core piece 202 and is bonded to the lateral wall 130 of the core piece 120 on an end of the assembly 200 described above. The assembly 300 as shown is suited for a four-phase electrical power system with similar benefits to those described above.

It should now be evident that the assembly is scalable to include still additional numbers of core pieces 120 and windings similar to the windings 104, 106. Using only two different shapes of core pieces 120 and 122 and a set of windings having the same shape, inductor components can be assembled having any desired number of windings.

FIGS. 5-8 are various views of a second exemplary embodiment of a surface mount, power inductor component assembly 400 that may be used in lieu of or in combination with the assemblies 100, 200, 300 on the circuit board 110.

The component assembly 400 includes a magnetic core fabricated from modular core pieces 404 and 406 with the windings 104 and 106 in between. The assembled core pieces 404 and 406 provide a component with similar proportions and overall dimensions to the core 102 described above, but with differently shaped modular core pieces.

Figure 6:
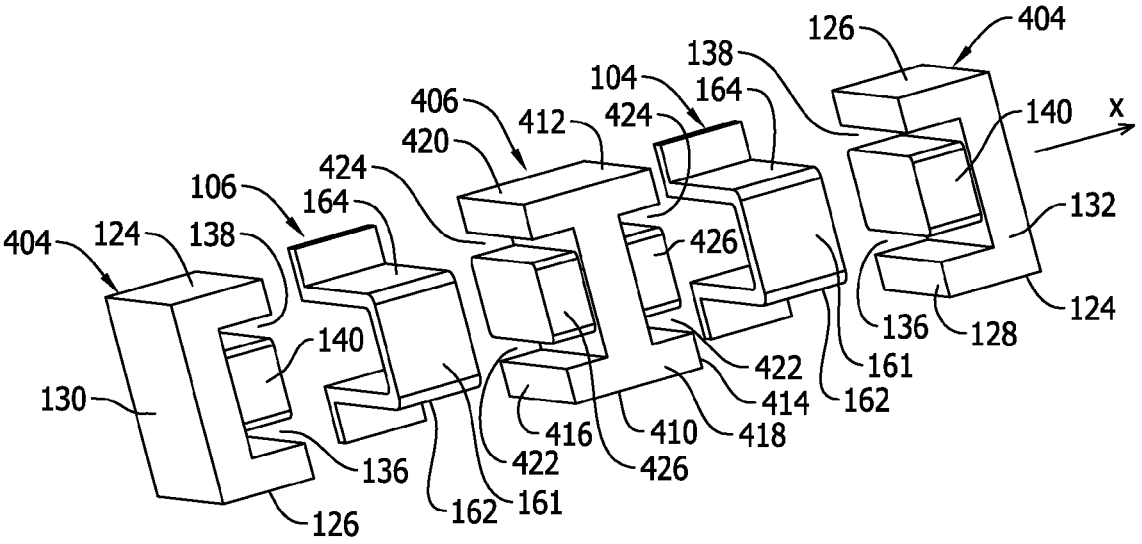
FIG. 6 is an exploded view of the power inductor component assembly shown in FIG. 5.

In the exploded view of FIG. 6, the core pieces 404 are similar to the core pieces 120 but are reduced in the x dimension. As such, the pieces 104 each include slots 136, 138 in the lateral wall 128 and the recessed surface 140 in the top wall 132. The pieces 404 receive the windings 104, 106 in a similar manner to that described above, but because of the reduced dimension of the pieces 404 in the x dimension, the slots 136, 138 receive only a portion of the winding legs 162, 164 and the winding section 161. More specifically, each piece 404 receives about one-half of the winding legs 162, 164 and about one-half of the winding section 161 of each winding 104, 106 in the x dimension.

Figure 5:
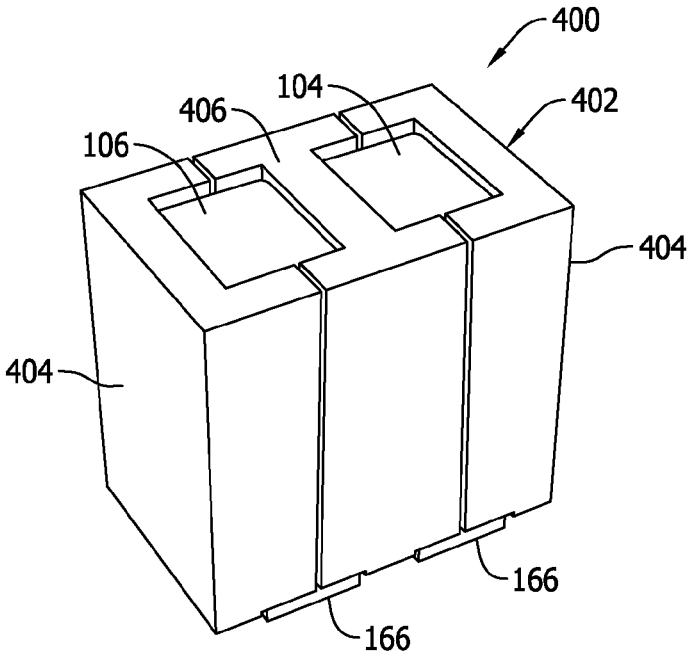
FIG. 5 is a top perspective view of a second exemplary embodiment of an electromagnetic surface mount, power inductor component assembly.

The core piece 406 in the assembly 400 is formed with opposing first and second longitudinal side walls 410 and 412, opposing first and second lateral side walls 414 and 416 interconnecting the first and second longitudinal side walls 410 and 412, and opposing top and bottom walls 418 and 420 interconnecting the respective first and second longitudinal side walls 410 and 412 and the respective first and second lateral side walls 414 and 416. In the context of FIGS. 5 and 6, the "bottom" wall 420 in each piece 406 is located adjacent the circuit board 110 and the "top" wall 418 is located at some distance from the circuit board 110.

The opposing lateral walls 414 and 416 of the core piece 4406 are shaped to receive a portion of the windings 104, 106. Accordingly, each wall 414, 416 includes spaced apart vertical slots 422, 424 and the top wall 418 includes a recessed surface 426. The slots 422, 424 and the recessed surface 426 on each opposing lateral wall 414 and 416 receives about one-half of the winding legs 162, 164 and about one-half of the winding section 161 of each winding 104, 106 in the x dimension.

The core pieces 406, 406 and the coil windings 106, 108 are inter-fit such that the vertical legs 162, 164 extend partly in the vertical slots 136, 138 in the core piece 404 and partly in the vertical slots 422, 424 of the core piece 406. Likewise, the section 161 of the windings 106, 108 is received partly on the recessed surface 140 of the core pieces 404 and partly on the recessed surface 426 of the piece 406. The core pieces 404, 406 are moved or drawn toward one other, with the vertical legs 162, 164 of the coil windings 106, 108 in the slots 136, 138 in each core piece 404, 406 until the lateral side walls 128, 414, 416 abut one another as seen in FIG. 5. The winding section 161 of the coil windings 106, 108 becomes seated in the inset depressed surfaces 140, 426 in each core piece 404, 406 as the core pieces 404, 406 are assembled.

As mentioned above, a physical gap may optionally be provided between the abutting core pieces 402, 404, 406 to enhance energy storage by, for example, reducing a dimension of the of the core pieces along the x axis in between the slots 136 and 138 and/or between the slots 422 and 424.

In the illustrated embodiment, about half of each vertical leg 162, 164 and about half of the winding section 161 of the coil windings 106, 108 are accommodated in each core piece 404, 406. The winding section 161 is exposed on the top surfaces 132 and 418 of each core piece 404 and 406 and the surface mount termination pads 166 are extended on both of the bottom surfaces of each core piece 404, 406.

The benefits of the assembly 400 are similar to the benefits of the assembly 100 described above.

Figure 7:
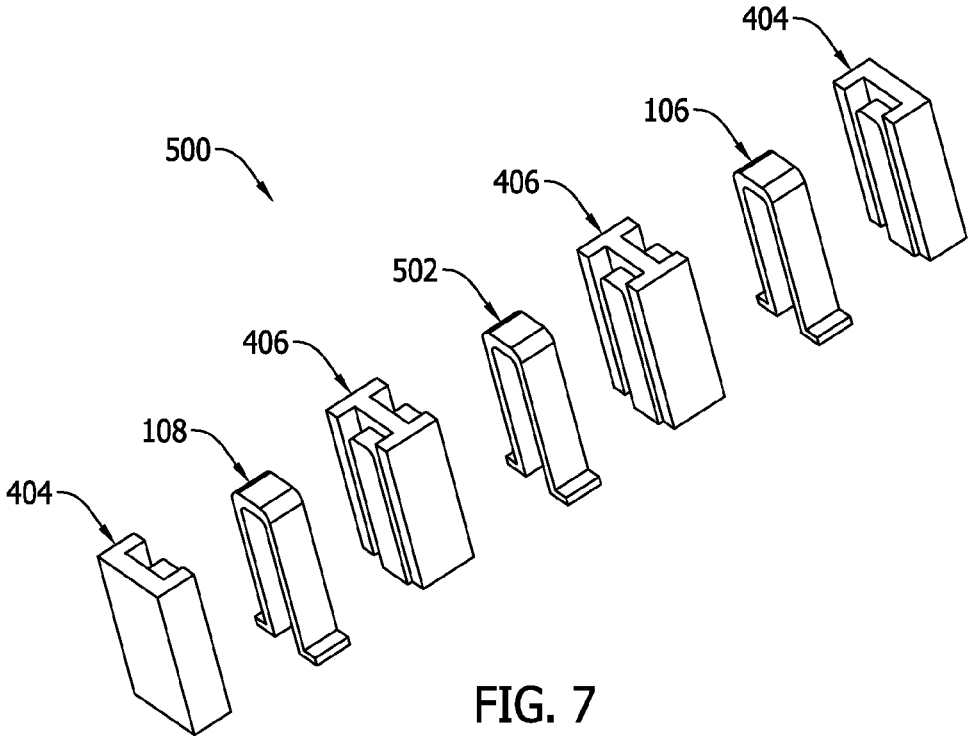
FIG. 7 is an exploded view of a scalable power inductor component assembly including the inductor component assembly shown in FIG. 5.
Figure 8:
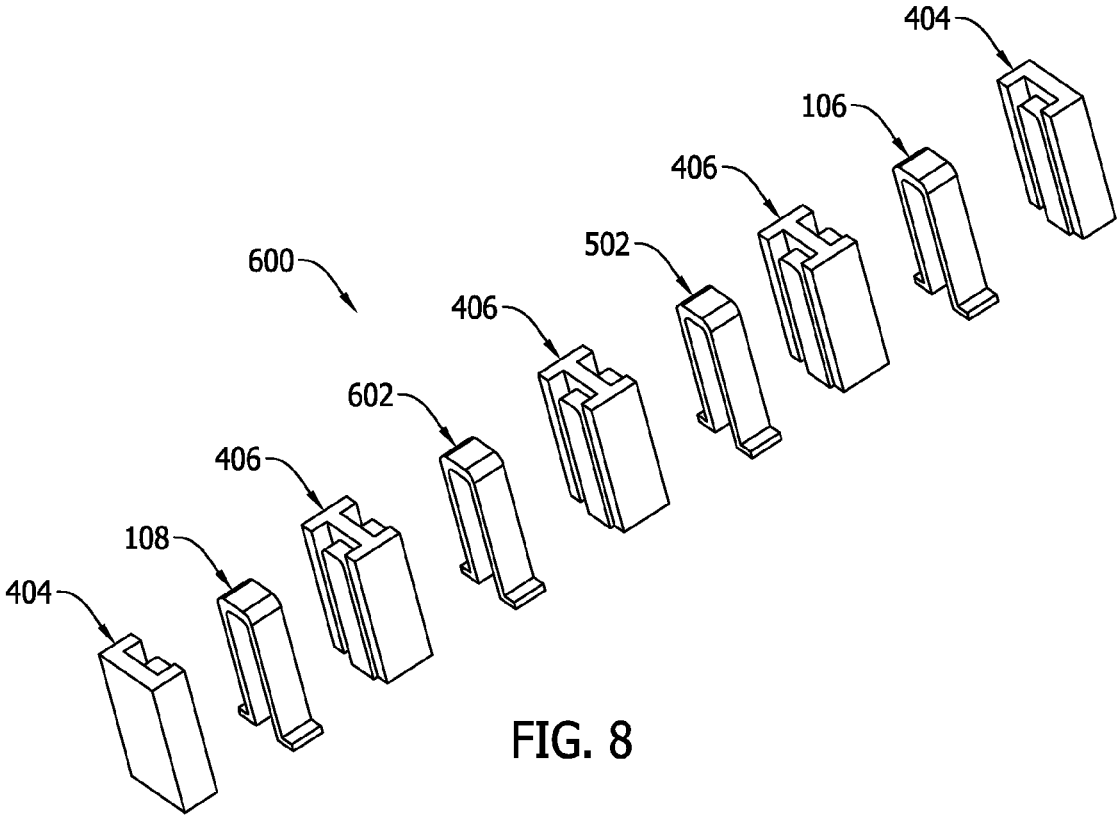
FIG. 8 is an exploded view of a scalable power inductor component assembly including the inductor component assembly shown in FIG. 7.
Figure 9:
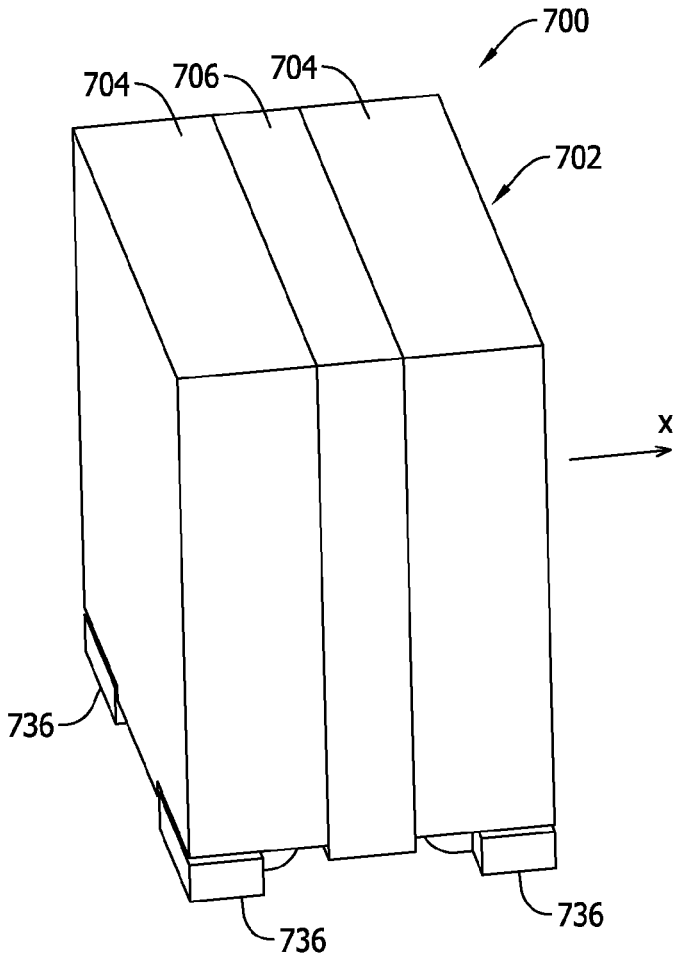
FIG. 9 is a top perspective view of a third exemplary embodiment of an electromagnetic surface mount, power inductor component assembly.

FIGS. 7 and 8 illustrate additional exploded views of inductor component assemblies 500, 600 including the assembly 400 and the use of additional core pieces 404 and 406 being arranged to easily expand configure the assembly to include additional windings.

In FIG. 7, a second core piece 406 is provided with a third winding 502 that is similar to the windings 104, 106. The third winding 502 and second core piece 406 are fitted between the first core piece 404 of the assembly 100 and one core piece 406 in the middle of the assembly 400 as shown. The assembly 500 as shown is suited for a three-phase electrical power system with similar benefits to those described above.

In FIG. 8, the assembly 500 is further expanded to include a third core piece 406 and a fourth winding 602 that is similar to the windings 104, 106. The fourth winding 602 is fitted with the third core piece 406 and another of the magnetic core pieces 406 in the middle of the assembly 500 as shown. The assembly 600 as shown is suited for a four-phase electrical power system with similar benefits to those described above.

It should now be evident that the assembly 400 is scalable to include still additional numbers of core pieces 406 and windings similar to the windings 104, 106. Using only two different shapes of core pieces 404 and 406 and a set of windings having the same shape, inductor components can be assembled having any desired number of windings.

FIGS. 9-13 are various views of a third exemplary embodiment of a surface mount, power inductor component assembly 700 that may be used in lieu of or in combination with the assemblies 100, 200, 300, 400, 500, 600 on the circuit board 110.

The component assembly 700 includes a magnetic core 702 fabricated from modular core pieces 704 and 706 with windings 708 and 710 in between. The assembled core pieces 704 and 706 provide a component with reduced proportions and overall dimension to the core 102 described above, particularly along the x axis and the length dimension L shown in FIG. 1.

Figure 10:
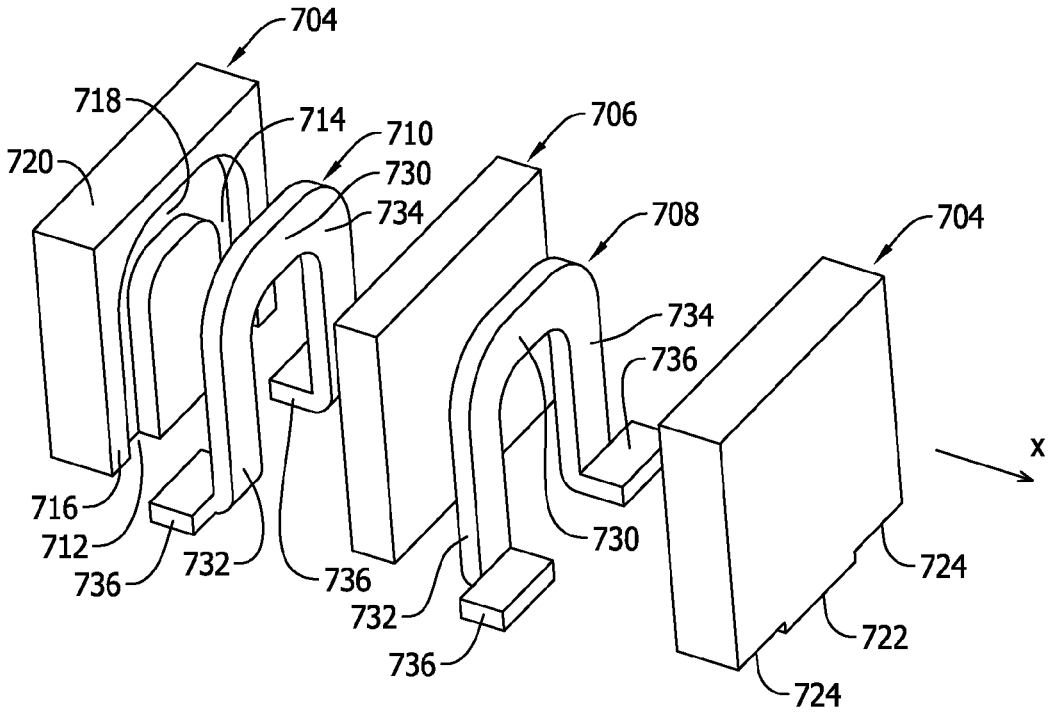
FIG. 10 is an exploded view of the power inductor component assembly shown in FIG. 9.
Figure 11:
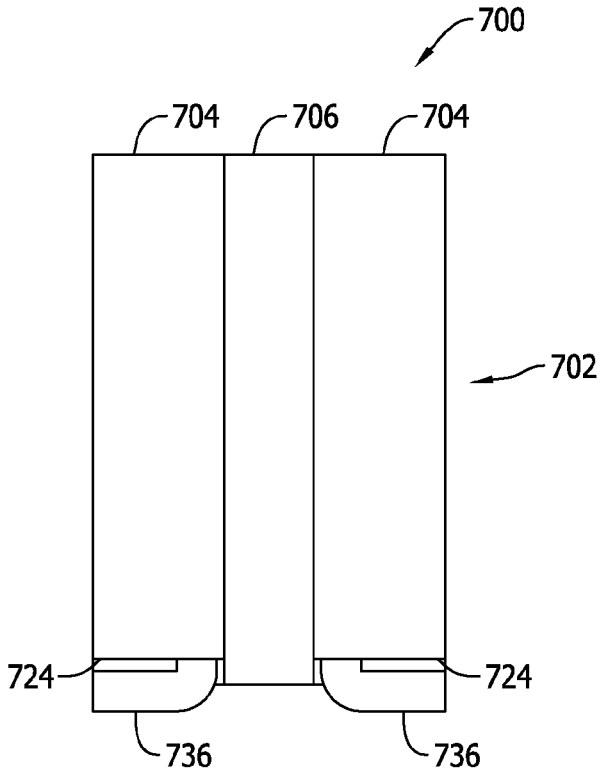
FIG. 11 is a lateral side elevational view of the power inductor component assembly shown in FIG. 9.
Figure 12:
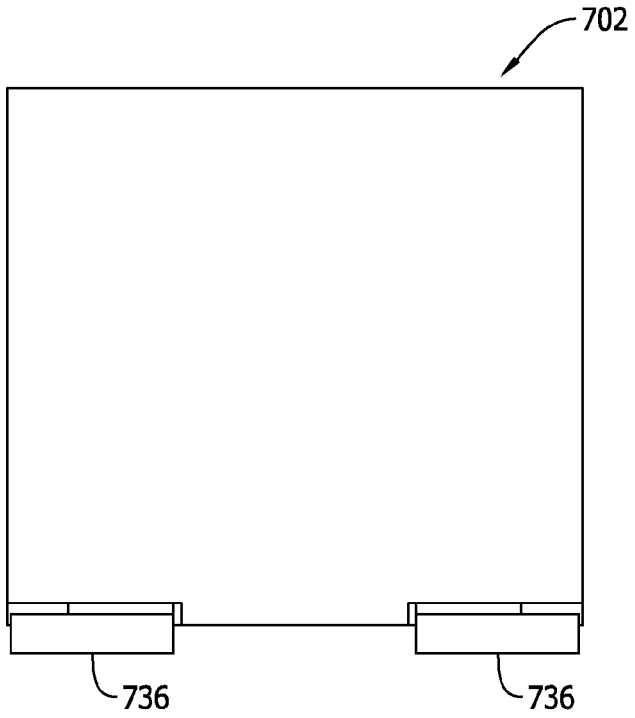
FIG. 12 is a longitudinal side elevational view of the power inductor component assembly shown in FIG. 9.

In the exploded view of FIG. 10, the core pieces 704 are only slightly larger in the x dimension than the core piece 706, which is similar to the core piece 122 described above in relation to FIG. 2. Like the previous embodiments, the pieces 704 each include spaced apart vertical slots 712, 714 in the lateral wall 716 facing the core piece 706. The core pieces 704 also include a horizontal slot 718 interconnecting the vertical slots 712, 714 in a spaced relation from the top wall 720 of each core piece 704. Compared to the previous embodiments, the slots 712, 714, 718 are wider and shallower. That is the slots 712, 714, 718 are not as deep to facilitate the reduction in the x dimension and are comparatively wider to accommodate the windings 708, 710 as further described below. A bottom wall 722 of each core piece 704 includes recessed surfaces 724 to accommodate a portion of the windings 708, 710*s*.

Each of the conductive windings 708 and 710 are formed as identically shaped and fabricated elements. Each winding 708, 710 is fabricated from a thin strip of conductive material that is bent or otherwise shaped or formed into the geometry shown. In the illustrated example, each winding 708, 710 includes a planar horizontal winding section 730 and first and second planar vertical legs 732, 734 each extending from the planar horizontal winding section 730 and opposing one another. As such, and in the illustrated example, the windings 708 and 710 are generally inverted U-shaped members with the section 730 being the base of the U and the legs 732, 734 extending downward from the section 161. Unlike the previously described windings, however, the vertical legs 732, 734 are coplanar with the horizontal section 730. Accordingly, the dimension of the windings in the x dimension between the core pieces 704, 706 is greatly reduced as only the thickness of the material used to fabricate the windings 708, 710 occurs along the x dimension, as opposed to the larger width dimension of the windings 104, 106 seen in FIG. 2.

In the illustrated embodiment, the legs 732, 734 are disproportionately longer that the section 730 along an axis of the winding. That is, the legs 732, 734 have a first axial length that is much larger than the axial length of the winding section 730. For example, the axial length of the legs 732, 734 may be about three times the axial length of the section 730, although this is not strictly necessary in all embodiments. The proportions of the windings 708, 710 facilitate a reduced footprint of the completed inductor component on the circuit board 110 as explained above, and the increased height of the windings 708, 710 provides a winding of sufficient length to capably handle higher current in a higher power electric system on the circuit board 110. The U-shaped windings 708, 710 define less than one complete turn in the magnetic core and are less complicated and more easily assembled than larger and more complex multi-turn coils.

Figure 13:
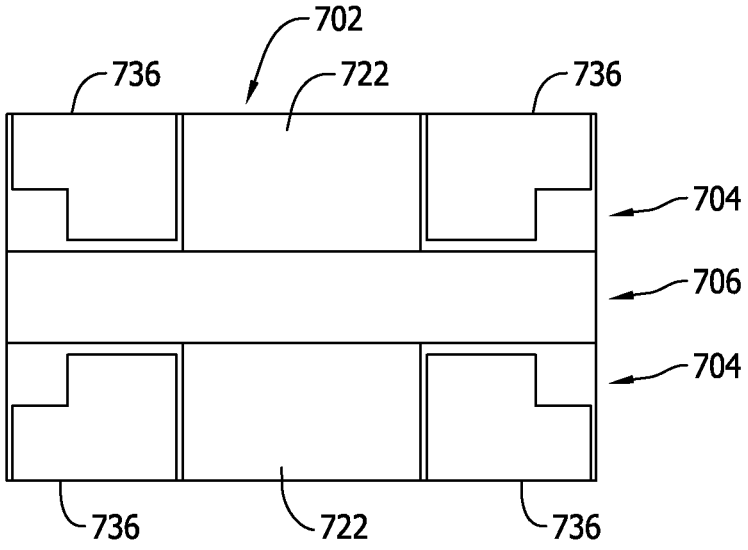
FIG. 13 is a bottom view of the power inductor component assembly shown in FIG. 9.

In the example shown, ends of the legs 732, 734 in each winding 708, 710 are further formed to include surface mount termination pads 736. The surface mount termination pads 736 extend perpendicularly to the plane of the legs 732, 734, extend generally coplanar to one another, and extend in the same direction from each leg 732, 734. The surface mount termination pads 736 provide a larger area for surface mounting to the circuit board 110, but in some cases may be considered optional and need not be provided. As seen in FIG. 13, the surface mount termination pads 736 extend to each respective outside corner of the magnetic core 702

The U-shaped windings 708, 710 are rather simply shaped and may be fabricated at low cost from a conductive sheet of material having a desired thickness into the three-dimensional shape as shown. The windings 708, 710 may be fabricated in advance as separate elements for assembly with the core pieces 704 and 706. That is, the windings 708, 710 may be pre-formed in the shape as shown for later assembly with the core pieces 704 and 706.

To assemble the component, the magnetic core pieces 704 receive the windings 708, 710 in a similar manner to that described above. The winding legs 732, 734 are entirely received in the vertical slots 712, 714 and the section 730 of each winding 708, 710 is entirely received in the horizontal slot 718 in each piece 804. The windings 708, 710 are, however, rotated 180° from one another so that the surface mount termination pads 736 extend beneath the respective pieces 704 with the surface mount termination pads 736 in the bottom recesses 724.

The pieces 704 including the windings may then be assembled with and attached to the core piece 706 that separates the coils and prevents magnetic coupling of the coils in use. A physical gap may optionally be provided between the abutting core pieces 704, 706 to enhance energy storage as desired. Unlike the embodiments described above, the horizontal winding section 730 is not exposed on the exterior of the component.

The benefits of the assembly 700 are similar to the benefits of the assembly 100 described above. The assembly 700 is likewise scalable by adding additional magnetic core pieces 704 and windings similar to the windings 708, 710 to one end of the assembly.

The benefits and advantages of the invention are now believed to have been amply illustrated in relation to the exemplary embodiments disclosed.

An inductor component assembly for power supply circuitry on a circuit board has been disclosed including first and second magnetic core pieces formed and arranged as mirror images of one another, each of the first and second magnetic core pieces comprising a top side wall, a bottom side wall, and a vertical sidewall including a first vertical slot and a second vertical slot extending in spaced apart relation from the first vertical slot. The assembly also includes a first conductive winding assembled to the first magnetic core piece and a second conductive winding assembled to the second magnetic core piece. Each of the first and second conductive winding defines less than one complete turn including a planar winding section and first and second legs each extending from the planar winding section and opposing one another, wherein the first and second planar legs of each respective first and second conductive winding are respectively received in the first vertical slot and the second vertical slot in each of the first and second magnetic core pieces. The assembly also includes a third magnetic core piece interposed between the vertical side walls of the first magnetic core piece and the second magnetic core piece and separating the first and second conductive windings from one another. The third magnetic core piece is differently shaped from the first and second magnetic core pieces and includes opposed top and bottom walls and opposed vertical side walls extending between the top and bottom walls, wherein a height dimension of the third magnetic core piece between the top and bottom walls is substantially greater than a width or length dimension of the third magnetic core piece. The first conductive winding and the second conductive winding are not magnetically coupled to one another when connected to a multi-phase power supply circuit on the circuit board.

Optionally, the third magnetic core is not shaped to receive any portion of the first and second conductive windings. Alternatively, the first and second opposed vertical walls of the third magnetic core piece are each formed with a pair of vertical slots, and the pair of vertical slots each receive a portion of the first and second planar legs of each of the first and second conductive windings. The planar winding section of each of the first and second conductive windings may be exposed on the top wall of the third magnetic core piece.

As further options, in each of the first and second conductive winding, the planar winding section may have a first axial length and the first and second planar legs may have a respective second axial length, with the second axial length being substantially greater than the first axial length. Each of the first and second conductive windings may include first and second planar surface mount termination portions that extend coplanar to one another on the bottom side wall of at least the respective first and second magnetic core pieces. The surface mount terminations may extend to outside corners of the bottom wall of the respective first and second magnetic core pieces. Each of the first and second magnetic core pieces may include a recess to receive to the surface mount terminations. The first and second conductive windings may be formed from a planar conductive piece of material having a width, and the first and second vertical slots in the first and second magnetic core pieces may be dimensioned to receive the entire width.

As one option, the planar winding section and the first and second planar legs in each of the first and second conductive windings may extend coplanar to one another. As another option, the first and second planar legs may extend perpendicularly to the plane of the planar winding section. The third magnetic core piece may optionally receive both of the first and second conductive windings.

The inductor component assembly may further include a number n of additional magnetic core pieces and an equal number n of additional conductive windings, with each additional magnetic core piece formed identically to one of the first and second magnetic core pieces, and each additional conductive winding formed identically to the first and second conductive windings and fitted to each respective additional magnetic core piece on an end of the assembly. Alternatively, each additional magnetic core piece may be formed identically to the third magnetic core piece, and each additional conductive winding may be formed identically to the first and second conductive windings and fitted to each respective additional magnetic core piece at a position between the third magnetic core piece and one of the first and second magnetic core pieces.

Another embodiment of a surface mount inductor component assembly for power supply circuitry on a circuit board has been disclosed. The inductor component assembly includes: a number n of conductive windings each defining less than one complete turn including a planar winding section and first and second legs each extending from the planar winding section and opposing one another, wherein the planar winding section has a first axial length and the first and second planar legs have a respective second axial length, the second axial length being substantially greater than the first axial length; a plurality of first magnetic core pieces having at least one side wall including vertical slots dimensioned to receive at least the first and second planar legs; at least some of the number n of conductive windings fitted in the vertical slots; at least one second magnetic core piece differently shaped from the plurality of first magnetic core pieces, the at least one second magnetic core piece interposed between a pair of the first magnetic core pieces; and wherein the number n of conductive windings are not magnetically coupled to one another when connected to the circuit board.

Optionally, the planar winding section of each conductive winding may be exposed on an outer surface of at least one of the plurality of first magnetic core pieces. The planar winding section and first and second legs of each conductive winding may be coplanar to one another. The at least one second magnetic core piece may be configured to receive a pair of the number n of conductive windings.

A method of fabricating a surface mount inductor component assembly for power supply circuitry on a circuit board has also been disclosed. The method includes: selecting a number n of conductive windings from a pre-formed set of identical windings, each identical winding defining less than one complete turn and having a planar winding section and first and second legs each extending from the planar winding section and opposing one another, wherein the planar winding section has a first axial length and the first and second planar legs have a respective second axial length, the second axial length being substantially greater than the first axial length; assembling at least some of the selected number n of conductive windings with a plurality of first magnetic core pieces having at least one side wall including vertical slots dimensioned to receive at least the first and second planar legs; arranging at least one second magnetic core piece differently shaped from the plurality of first magnetic core pieces between at least one pair of the plurality of first magnetic core pieces; and bonding the first and second magnetic core pieces to one another; wherein the number n of conductive windings are spaced apart from one another by an amount sufficient to avoid magnetic coupling with one another when connected to the circuit board.

Optionally, the method may further include receiving first and second ones of the selected number n of conductive windings into opposing side walls of the at least one second magnetic core piece.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inductor component assembly for power supply circuitry on a circuit board, the inductor component assembly comprising:

first and second magnetic core pieces formed and arranged as mirror images of one another, each of the first and second magnetic core pieces comprising a top side wall, a bottom side wall, and a vertical sidewall including a first vertical slot and a second vertical slot extending in spaced apart relation from the first vertical slot;

a first conductive winding assembled to the first magnetic core piece and a second conductive winding assembled to the second magnetic core piece, each of the first and second conductive winding defining less than one complete turn including a planar winding section and first and second legs each extending from the planar winding section and opposing one another, wherein the first and second planar legs of each respective first and second conductive winding are respectively received in the first vertical slot and the second vertical slot in each of the first and second magnetic core pieces; and a third magnetic core piece interposed between the vertical side walls of the first magnetic core piece and the second magnetic core piece and separating the first and second conductive windings from one another, the third magnetic core piece being differently shaped from the first and second magnetic core pieces and comprising opposed top and bottom walls and opposed vertical side walls extending between the top and bottom walls, wherein a height dimension of the third magnetic core piece between the top and bottom walls is substantially greater than a width or length dimension of the third magnetic core piece; and wherein the first conductive winding and the second conductive winding are not magnetically coupled to one another when connected to a multi-phase power supply circuit on the circuit board.

2. The inductor component assembly of claim 1, wherein the third magnetic core piece is not shaped to receive any portion of the first and second conductive windings.

3. The inductor component assembly of claim 1, wherein the first and second opposed vertical walls of the third magnetic core piece are each formed with a pair of vertical slots, and the pair of vertical slots each receive a portion of the first and second planar legs of each of the first and second conductive windings.

4. The inductor component assembly of claim 3, wherein the planar winding section of each of the first and second conductive windings is exposed on the top wall of the third magnetic core piece.

5. The inductor component assembly of claim 1, wherein in each of the first and second conductive winding, the planar winding section has a first axial length and the first and second planar legs have a respective second axial length, the second axial length being substantially greater than the first axial length.

6. The inductor component assembly of claim 5, wherein each of the first and second conductive windings includes first and second planar surface mount termination portions that extend coplanar to one another on the bottom side wall of at least the respective first and second magnetic core pieces.

7. The inductor component assembly of claim 6, wherein the surface mount terminations extend to outside corners of the bottom wall of the respective first and second magnetic core pieces.

8. The inductor component assembly of claim 6, wherein each of the first and second magnetic core pieces includes a recess to receive to the surface mount terminations.

9. The inductor component assembly of claim 1, wherein the first and second conductive windings are formed from a planar conductive piece of material having a width, and the first and second vertical slots in the first and second magnetic core pieces are dimensioned to receive the entire width.

10. The inductor component assembly of claim 1, wherein the planar winding section and the first and second planar legs in each of the first and second conductive windings extend coplanar to one another.

11. The inductor component assembly of claim 1, wherein the first and second planar legs extend perpendicularly to the plane of the planar winding section.

12. The inductor component assembly of claim 1, wherein the third magnetic core piece receives both of the first and second conductive windings.

13. The inductor component assembly of claim 1, further comprising a number n of additional magnetic core pieces and an equal number n of additional conductive windings, each additional magnetic core piece formed identically to one of the first and second magnetic core pieces, and each additional conductive winding formed identically to the first and second conductive windings and fitted to each respective additional magnetic core piece on an end of the assembly.

14. The inductor component assembly of claim 1, further comprising a number n of additional magnetic core pieces and an equal number n of additional conductive windings, each additional core piece formed identically to the third magnetic core piece, and each additional conductive winding formed identically to the first and second conductive windings and fitted to each respective additional magnetic core piece at a position between the third magnetic core piece and one of the first and second magnetic core pieces.

15. A surface mount inductor component assembly for power supply circuitry on a circuit board, the inductor component assembly comprising:

a number n of conductive windings each defining less than one complete turn including a planar winding section and first and second legs each extending from the planar winding section and opposing one another, wherein the planar winding section has a first axial length and the first and second planar legs have a respective second axial length, the second axial length being substantially greater than the first axial length;

a plurality of first magnetic core pieces having at least one side wall including vertical slots dimensioned to receive at least the first and second planar legs;

at least some of the number n of conductive windings fitted in the vertical slots;

at least one second magnetic core piece differently shaped from the plurality of first magnetic core pieces, the at least one second magnetic core piece interposed between a pair of the first magnetic core pieces; and wherein the number n of conductive windings are not magnetically coupled to one another when connected to the circuit board.

16. The inductor component assembly of claim 1, wherein the planar winding section of each conductive winding is exposed on an outer surface of at least one of the plurality of first magnetic core pieces.

17. The inductor component assembly of claim 1, wherein the planar winding section and first and second legs in each conductive winding are coplanar to one another.

18. The inductor component assembly of claim 1, wherein the at least one second magnetic core piece is configured to receive a pair of the number n of conductive windings.

19. A method of fabricating a surface mount inductor component assembly for power supply circuitry on a circuit board, the method comprising:

selecting a number n of conductive windings from a pre-formed set of identical windings, each identical winding defining less than one complete turn and having a planar winding section and first and second legs each extending from the planar winding section and opposing one another, wherein the planar winding section has a first axial length and the first and second planar legs have a respective second axial length, the second axial length being substantially greater than the first axial length;

assembling at least some of the selected number n of conductive windings with a plurality of first magnetic core pieces having at least one side wall including vertical slots dimensioned to receive at least the first and second planar legs;

arranging at least one second magnetic core piece differently shaped from plurality of first magnetic core pieces between at least one pair of plurality of first magnetic core pieces; and bonding the first and second magnetic core pieces to one another;

wherein the number n of conductive windings are spaced apart from one another by an amount sufficient to avoid magnetic coupling with one another when connected to the circuit board.

20. The method of claim 19, further comprising receiving first and second ones of the selected number n of conductive windings into opposing side walls of the at least one second magnetic core piece.

* * * * *